US005173041A

United States Patent [19]

Niimura et al.

[11] Patent Number: 5,173,041

[45] Date of Patent: Dec. 22, 1992

[54] MULTISTAGE VACUUM PUMP WITH INTERSTAGE SOLID MATERIAL COLLECTOR AND COOLING COILS

[75] Inventors: Yasuhiro Niimura; Harumitsu Saito, both of Tokyo, Japan

[73] Assignee: Ebara Corporation, Tokyo, Japan

[21] Appl. No.: 757,954

[22] Filed: Sep. 12, 1991

[30] Foreign Application Priority Data

Sep. 21, 1990 [JP] Japan ..... 2-252988

[51] Int. Cl.[5] ..... F04C 23/00

[52] U.S. Cl. ..... 418/9; 417/313; 418/46; 418/181

[58] Field of Search ..... 418/9, 15, 46, 47, 180, 418/181, 206; 417/205, 245, 243, 246, 247, 249, 313

[56] References Cited

U.S. PATENT DOCUMENTS

| | | | |
|---|---|---|---|
| 1,769,153 | 7/1930 | Meyer | 418/47 |
| 2,489,887 | 11/1949 | Houghton | 418/180 |
| 2,849,173 | 8/1958 | Surdy | 417/246 |
| 4,066,386 | 1/1978 | Johnson et al. | 417/245 |
| 4,087,197 | 5/1978 | Haugen | 417/243 |
| 4,789,314 | 12/1988 | Higuchi et al. | 417/243 |
| 4,943,215 | 7/1990 | Berges | 418/9 |

FOREIGN PATENT DOCUMENTS

| | | | |
|---|---|---|---|
| 0272767 | 6/1988 | European Pat. Off. . | |
| 0332741 | 9/1989 | European Pat. Off. . | |
| 0448750 | 10/1991 | European Pat. Off. . | |
| 2056353 | 5/1972 | Fed. Rep. of Germany . | |
| 2-642479 | 8/1990 | France | 417/243 |
| 59-229072 | 12/1984 | Japan | 417/245 |
| 61-197793 | 9/1986 | Japan | 417/243 |
| 62-107287 | 5/1987 | Japan | 417/243 |
| 62-189388 | 8/1987 | Japan . | |
| 1-247787 | 10/1989 | Japan . | |
| 2-245493 | 10/1990 | Japan . | |

OTHER PUBLICATIONS

Patent Abstracts of Japan, vol. 12, No. 39, Feb. 1988 & JP-A-62 189 388 Aug. 19, 1987.

*Primary Examiner*—Leonard E. Smith

*Attorney, Agent, or Firm*—Oblon, Spivak, McClelland, Maier & Neustadt

[57] ABSTRACT

A multistage vacuum pump including a plural set of two lobe type vacuum pumps arranged on a common shaft for rotors and in a common casing. The adjacent pumps are connected in series with each other through a communicating passage formed in a pump casing. A solid material collector having a cooling device is provided in the communicating passage so that it is dismountable from the pump casing. A solid component in a compressed gas is forcibly produced by and adhered to the solid material collector. Thus, it is not necessary to disassemble the pump casing for cleaning the same.

3 Claims, 4 Drawing Sheets

MULTISTAGE VACUUM PUMP WITH INTERSTAGE SOLID MATERIAL COLLECTOR AND COOLING COILS

BACKGROUND OF THE INVENTION

1. Field of the Invention:

The present invention relates to a multistage vacuum pump including a plural set of a plural lobe type vacuum pumps arranged on a common shaft for rotors and in a common casing.

2. Prior Art:

In general, in order to obtain a high vacuum, a plurality of single-stage vacuum pumps are arrayed in series. Particularly of late, however, a multistage vacuum pump having a plurality of rotors provided on a common shaft has been employed so as to provide a miniaturized vacuum pump. Its application is diversified including a case where a sublimable gas is handled. The sublimable gas has a property to change, as shown in FIG. 6, from a gas to a solid or from a solid to a gas according to a change in the state of pressure and temperature.

In case a sublimable gas is handled by a multistage vacuum pump as referred to above, however, there, entailed a problem that a solid material is produced within the pump as the gas is compressed successively from an inlet port and arrives at a discharge port, and this greatly decreases the lifetime of the pump. Particularly when the solid material adheres to fine gaps in a rotor portion (compression part), the pump stops instantaneously. Thus, a pump body must be disassembled, cleaned and reassembled in each such occasion, which involves much time and troublesome labor.

SUMMARY OF THE INVENTION

The present invention has been carried out in view of the aforementioned circumstances, and its object is to remove problems stated above and hence to provide a multistage vacuum pump where a solid material will not adhere to a compression part and disassembling of a pump body is not required and thus ensuring a long lifetime and stable operation.

In order to accomplish the aforementioned objects, the present invention provides a multistage vacuum pump including a plural set of a plural lobe type vacuum pumps arranged on a common shaft for rotors and in a common casing, the adjacent pumps being connected in series with each other through a communicating passage formed in a pump casing, wherein a solid material collector having a cooling means is provided in the communicating passage so that it is dismountable from the pump casing.

The invention further provides a structure wherein the communicating passage on a downstream side of the solid material collector is provided adjacent to a discharge portion of a pump chamber on the front stage, and a fluid from the front stage flows into a pump chamber on the rear stage by way of the communicating passage.

In a multistage vacuum pump of the invention, since a solid material collector having a cooling means is provided in the communicating passage so that it is dismountable from a pump casing as mentioned above, a solid material produced within the pump is collected by the solid material collector and, therefore, the solid material will little flow into the pump in the next stage. Further, since the solid material collector is dismountable from the pump casing, the pump body can be washed simply by dismounting the solid collector only and without disassembling the pump body.

Further, by forming the communicating passage on a downstream side of the solid material collector adjacent to a discharge portion of a pump chamber on the front stage, a fluid coming out of the solid material collector passes through the communicating passage and is subjected to heat generated by compression from the discharge portion of the pump chamber on the front stage and, thus the temperature thereof is raised for a perfect vaporization. Therefore, the fluid from the front stage flows into a pump chamber on the next stage without involving any solid material.

The above and other objects, features and advantages of the present invention will become more apparent from the following description when taken in conjunction with the accompanying drawings in which a preferred embodiment of the present invention is shown by way of illustrative examples.

BRIEF DESCRIPTION OF THE DRAWINGS

FIG. 1 to FIG. 3 are illustrations representing a structure of a multistage vacuum pump according to one embodiment of the present invention, wherein FIG. 1 is a longitudinal sectional view of the embodiment, FIG. 2 and FIG. 3 are sectional views taken on lines II—II and III—III of FIG. 1 respectively;

FIG. 4 and FIG. 5 are illustrations exemplifying a structure of a solid material collector used in a multistage vacuum pump of the present invention, wherein FIG. 4 represents a state where a cooling coil is inserted in a collector housing, and FIG. 5 represents a state where the cooling coil is drawn out of the collector housing.

DETAILED DESCRIPTION OF THE PREFERRED EMBODIMENTS

One embodiment of the present invention will now be described with reference to the accompanying drawings.

Figure 1:
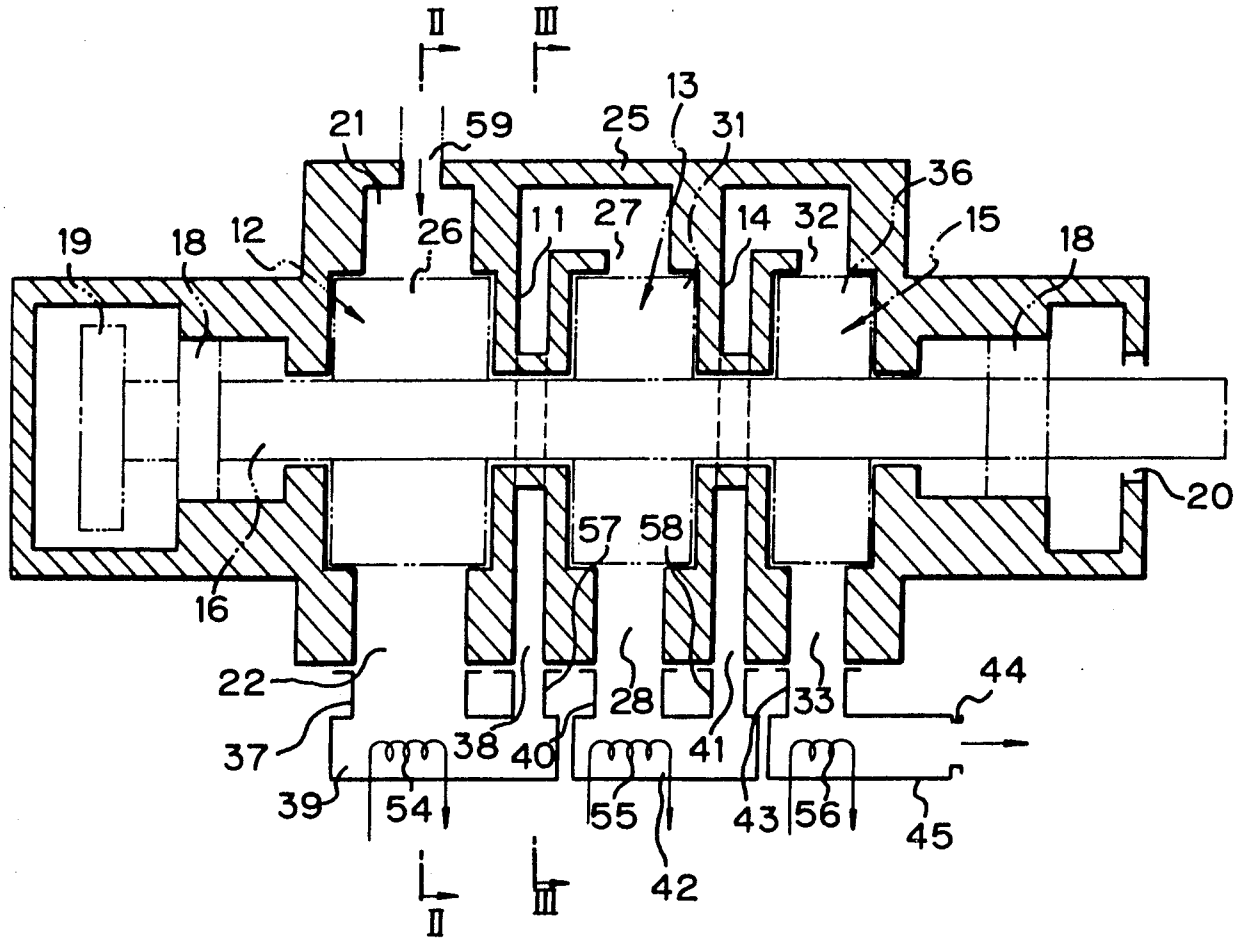
Figure 2:
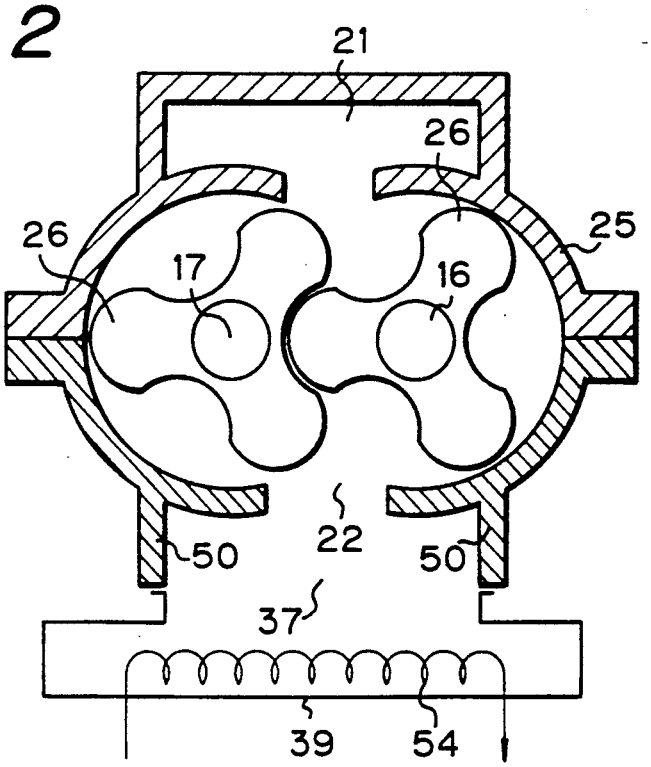
Figure 3:
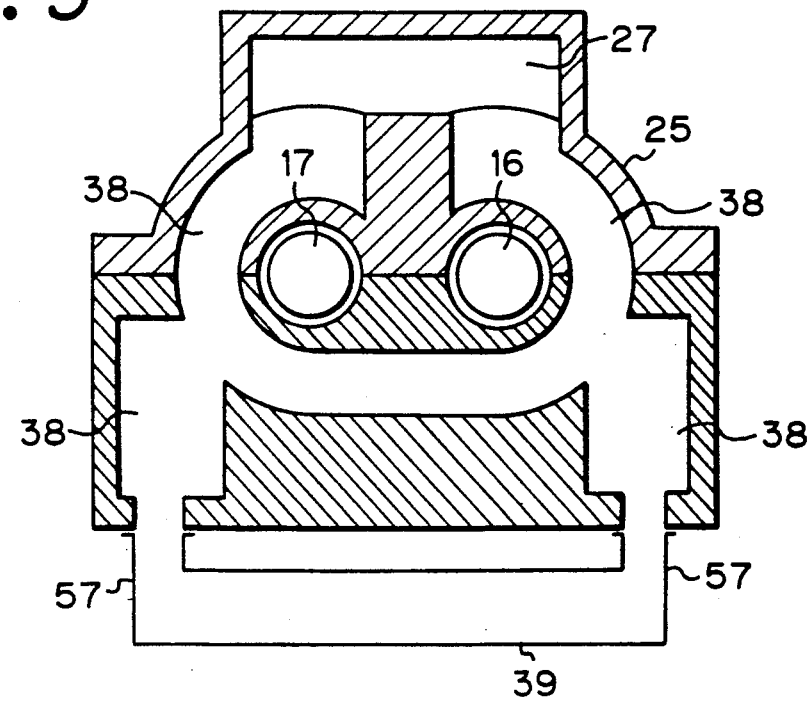

FIG. 1 to FIG. 3 represent a structure of a multistage vacuum pump according to one embodiment of the invention, wherein FIG. 1 is a longitudinal sectional view of the vacuum pump (rotating shafts and rotors being indicated by two-dot chain lines), and FIG. 2 and FIG. 3 are sectional views taken on lines II—II and III—III of FIG. 1 respectively. A reference numeral 25 denotes a pump casing, having three operating rooms, namely a first pump chamber 12, a second pump chamber 13 and a third pump chamber 15 formed by partition walls 11, 14. The pump casing 25 is divided into two up and down halves in structure as a whole.

Two rotating shafts 16, 17 disposed in parallel are supported rotatably by a bearing 18 within the casing 25. Two lobe type rotors 26, 31, 36 each paired and engaged with each other are enclosed within the first pump chamber 12, the second pump chamber 13 and the third pump chamber 15 respectively, and are fixed on the common rotating shafts 16, 17 as shown.

Driving means not indicated is coupled to an end of the one rotating shaft 16 passing through a shaft seal 20, and by rotating the shaft 16 by the driving means, the rotating shaft 17 rotates in reverse direction against the rotating shaft 16 through a timing gear 19, and thus the two lobe type rotors 26, 31, 36 are rotated.

Then, inlet ports 21, 27, 32 and discharge ports 22, 28, 33 are formed in the first pump chamber 12, the second pump chamber 13 and the third pump chamber 15 respectively.

Communicating passages 38, 41 are formed within the pump casing 25 between the first pump chamber 12, the second pump chamber 13 and between the second pump chamber 13 and the third pump chamber 15 respectively, and are in communication with the inlet ports 27, 32 of the second pump chamber 13 and the third pump chamber 15 respectively.

Reference numerals 39, 42, 45 represent solid material collectors having cooling coils 54, 55, 56, inlet openings 37, 40, 43 and outlet openings 57, 58, 44 respectively. The inlet openings 37, 40, 43 of these solid material collectors 39, 42, 45 are connected to the discharge ports 22, 28, 33 of the first, second and third pump chambers 12, 13, 15 respectively. The outlet openings 57, 58 of the solid material collectors 39, 42 are connected to the communicating passages 38, 41 respectively.

In the multistage vacuum pump constructed as above, a gas sucked in the first pump chamber 12 through an inlet port 59 is shifted to the solid material collector 39 by the rotor 26 through the inlet opening 37, cooled by the cooling coil 54 in the solid material collector 39, and is then fed to the second pump chamber 13 by way of the outlet opening 57 of the solid material collector 39, the communicating passage 38 and the inlet port 27 of the second pump chamber 13.

The gas fed to the second pump chamber 13 is then shifted to the solid material collector 42 by the rotor 31 through the discharge port 28 and the inlet opening 40, cooled by the cooling coil 55 in the solid material collector 42, and is then fed to the third pump chamber 15 by way of the outlet opening 58, the communicating passage 41 and the inlet port 32. passage 41 and the inlet port 32.

The gas fed to the third pump chamber 15 is then shifted to the solid material collector 45 by the rotor 36 through the discharge port 33 and the inlet opening 43, cooled by the cooling coil 56 in the solid material collector 45, and is then let out through a discharge port 44.

During such multistage compression, a solid component is forcibly produced from the gas compressed by the rotors 26, 31, 36 by the cooling coils 54, 55, 56 in the solid material collectors 39, 42, 45 and is adhered thereto. Further a fluid coming out of the solid material collectors 39, 42 which passes through the communicating passages 38, 41 is subjected to heat generated by compression from the adjacent discharge ports 22, 28, and the temperature thereof is raised so as to completely vaporize, and flows into the next inlet ports 27, 32. Thus, the gas flowing into the second pump chamber 13 and the third pump chamber 15 does not involve any solid component. Therefore a stable operation of the multistage vacuum pump is obtained, thereby prolonging the lifetime of the pump.

Figure 4:
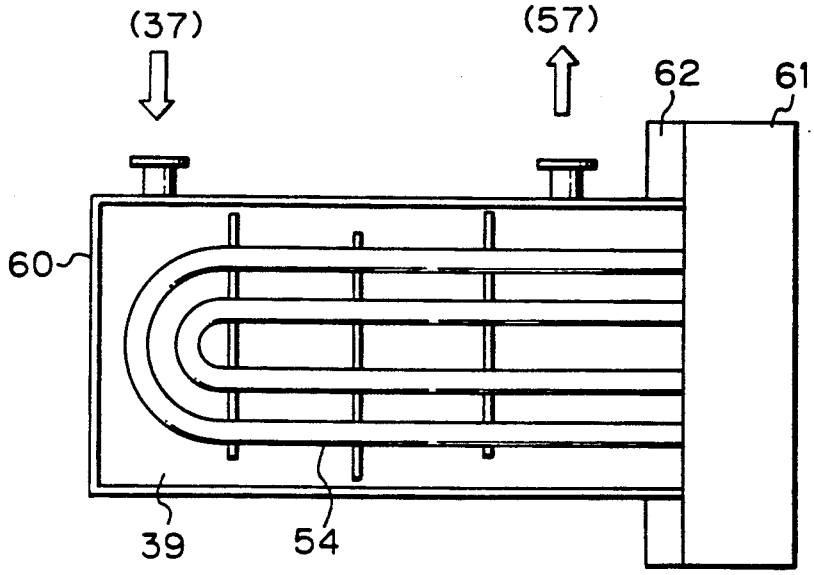
Figure 5:
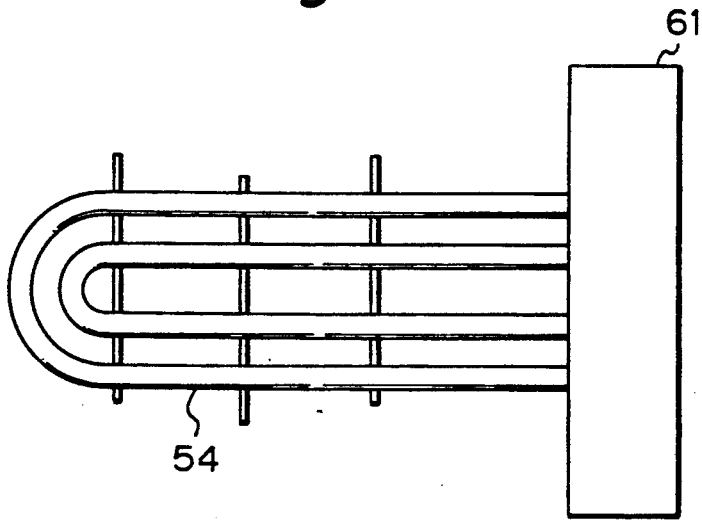
Figure 6:
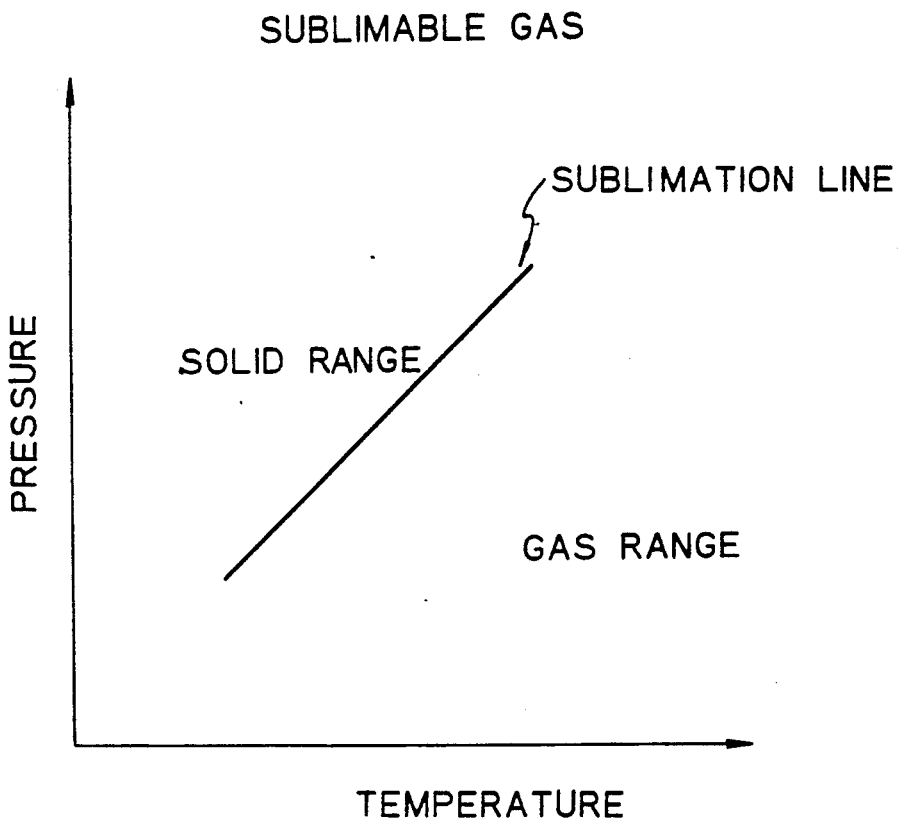
FIG. 6 is an illustration showing a property of a sublimable gas.

FIG. 4 and FIG. 5 exemplify a structure of the solid material collector 39. A reference numeral 60 denotes a collector housing on which the inlet opening 37 and the outlet opening 57 are provided, and the cooling coil 54 is contained within the collector housing 60. The cooling coil 54 is mounted on a coil mounting member 61, allowing a refrigerant to flow therein. After inserting the cooling coil 54 into the collector housing 60, the coil mounting member 61 is fixable to a flange 62 mounted on an end portion of the collector housing 60 by means of a bolt or other fixing means. FIG. 5 represents a state where the coil mounting member 61 is dismounted from the flange 62, and the cooling coil 54 is drawn out of the collector housing 60.

The solid material collector 39 is mounted on the pump casing 25 so that the inlet opening 37 and the outlet opening 57 are connected to the discharge port 22 and the communicating passage 38 respectively as stated above and only the cooling coil 54 may be dismounted from the pump casing 25 without dismounting the collector housing 60 therefrom.

Since only the cooling coil 54 of the solid material collector 39 is ready for dismounting as described above, the solid component adhered to the cooling coil 54 can be drawn and washed without disassembling a body of the multistage vacuum pump, and therefore a maintenance of the solid material collector 39 will be facilitated.

The structures of the solid material collectors 42 and 45 are substantially the same as the structure of the solid material collector 39, therefore illustration and description thereof will be omitted here.

Incidentally, FIG. 4 and FIG. 5 represent only one example of the solid material collector, and hence the solid material collector is not necessarily limited thereto. Thus, as a matter of course, any structure comprising a structure disposed on a communicating passage, having a cooling function and being dismountable from the pump casing may be used.

As described above, according to the present invention, the following advantageous effects will be ensured.

(1) By providing a solid material collector having a cooling means in a communicating passage, so that it is dismountable from the pump casing, a solid component produced within the pump is collected by the solid material collector. Therefore the solid component does not flow into the pump in the next stage, and no solid component will adhere to fine gaps in the rotor part (compression part), and thus a stable operation of the pump and a prolonged lifetime thereof is ensured.

(2) Then, since the solid material collector is dismountable from the pump casing, only the solid material collector can be dismounted for washing without disassembling the pump body.

(3) When the communicating passage on a downstream side of the solid material collector is formed adjacent to a discharge portion of the pump chamber on the front stage, a fluid coming out of the solid material collector passes through the communicating passage and is subjected to heat generated by compression from the discharge portion of the pump chamber on the front stage and the temperature thereof is raised for a perfect vaporization. Therefore, the fluid from the front stage flows into the pump chamber on the next stage in the state free from a solid matter, and hence the pump can be operated stably and its lifetime will be prolonged as well.

What is claimed is:

1. In a multistage vacuum pump including a plural set of two lobe type vacuum pumps arranged on a common shaft for rotors and in a common casing, the adjacent pumps being connected in series with each other through a communicating passage formed in a pump casing;

the improvement characterized in that a solid material collector having a cooling means for collecting a solid material in a pump fluid by cooling is provided in said communicating passage so that the whole pump fluid is passed through said cooling means, wherein said solid material collector is dismountable from said pump casing, said communicating passage on a downstream side of said solid material collector is formed adjacent to a discharge portion of a pump chamber on a front pump stage, and a fluid from the front pump stage flows into a pump chamber on a rear pump stage by way of said communicating passage while being heated by heat transmitted from said discharge portion.

2. The multistage vacuum pump claimed in claim 1, wherein said solid material collector includes a collector housing containing said cooling coil therein, an inlet opening and an outlet opening provided in said collector casing, said inlet opening and said outlet opening are connected to said outlet portion of said pump chamber on the front pump stage and said communicating passage respectively.

3. The multistage vacuum pump claimed in claim 2, wherein said solid material collector includes a coil mounting member fixedly mounting said cooling coil thereon and removably mounted on said collector housing, whereby said coil mounting member is removable from said pump casing without dismounting said collector housing from the same.

* * * * *